US007869753B2

(12) United States Patent
Shinshi

(10) Patent No.: US 7,869,753 B2
(45) Date of Patent: Jan. 11, 2011

(54) FIXING DEVICE AND IMAGE FORMING APPARATUS

(75) Inventor: Akira Shinshi, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 140 days.

(21) Appl. No.: 12/073,667

(22) Filed: Mar. 7, 2008

(65) Prior Publication Data

US 2008/0219730 A1 Sep. 11, 2008

(30) Foreign Application Priority Data

Mar. 8, 2007 (JP) ..... 2007-057936

(51) Int. Cl.
*G03G 15/20* (2006.01)

(52) U.S. Cl. ..... 399/329; 399/333

(58) Field of Classification Search ..... 399/329, 399/333, 334, 122, 328
See application file for complete search history.

(56) References Cited

U.S. PATENT DOCUMENTS

| | | | | |
|---|---|---|---|---|
| 6,631,253 | B2 * | 10/2003 | Nakafuji et al. | 399/329 |
| 6,882,820 | B2 | 4/2005 | Shinshi et al. | |
| 6,989,516 | B1 * | 1/2006 | Domoto | 219/619 |
| 7,127,204 | B2 | 10/2006 | Satoh et al. | |
| 7,239,838 | B2 | 7/2007 | Sato et al. | |
| 7,242,897 | B2 | 7/2007 | Satoh et al. | |
| 2003/0063931 | A1 * | 4/2003 | Sanpei et al. | 399/328 |
| 2004/0013453 | A1 | 1/2004 | Shinshi et al. | |
| 2005/0163543 | A1 | 7/2005 | Satoh et al. | |
| 2005/0286938 | A1 * | 12/2005 | Aze et al. | 399/328 |
| 2006/0002737 | A1 | 1/2006 | Shinshi | |
| 2006/0116230 | A1 | 6/2006 | Satoh et al. | |
| 2006/0165429 | A1 | 7/2006 | Satoh et al. | |
| 2007/0003334 | A1 | 1/2007 | Shinshi et al. | |
| 2007/0014603 | A1 | 1/2007 | Satoh et al. | |
| 2007/0059003 | A1 | 3/2007 | Shinshi et al. | |
| 2007/0059071 | A1 | 3/2007 | Shinshi et al. | |
| 2007/0110464 | A1 | 5/2007 | Nakayama et al. | |
| 2007/0166085 | A1 | 7/2007 | Shinshi | |
| 2007/0292175 | A1 * | 12/2007 | Shinshi | 399/329 |

(Continued)

FOREIGN PATENT DOCUMENTS

| | | |
|---|---|---|
| JP | 11-002982 | 1/1999 |

(Continued)

OTHER PUBLICATIONS

Machine translation of Nakato et al. (JP 2002-251084, Listed in IDS).*

(Continued)

*Primary Examiner*—David M Gray
*Assistant Examiner*—Rodney Bonnette
(74) *Attorney, Agent, or Firm*—Harness, Dickey & Pierce, P.L.C.

(57) ABSTRACT

A fixing device includes a flexible endless fixing member that travels in a prescribed direction and applies heat and melts a toner image, a pressure applying member that pressure contacts the fixing member and forms a nip for conveying a recording medium, and a resistance heat element secured inside an inner circumferential surface of the fixing member, which applies heat to the fixing member. The resistance heat element is arranged not to pressure contact the inner circumferential surface of the fixing member.

22 Claims, 5 Drawing Sheets

U.S. PATENT DOCUMENTS

| | | | | |
|---|---|---|---|---|
| 2008/0112739 | A1* | 5/2008 | Shinshi | 399/329 |
| 2009/0311016 | A1* | 12/2009 | Shinshi | 399/329 |

FOREIGN PATENT DOCUMENTS

| | | |
|---|---|---|
| JP | 11-327331 | 11/1999 |
| JP | 2001-083822 | 3/2001 |
| JP | 2002-006656 | 1/2002 |
| JP | 2002-075603 | 3/2002 |
| JP | 2002-251084 | 9/2002 |
| JP | 2002-311735 | 10/2002 |

OTHER PUBLICATIONS

U.S. Appl. No. 11/812,287.*
U.S. Appl. No. 11/979,918.*
U.S. Appl. No. 11/812,387 (Pub No. US 2007/0292175 A1).*
U.S. Appl. No. 11/979,918 (Pub No. US 2008/0112739 A1).*
U.S. Appl. No. 11/812,387 (Pub No. US 2009/0311016 A1).*

* cited by examiner

FIXING DEVICE AND IMAGE FORMING APPARATUS

CROSS REFERENCE TO RELATED APPLICATION

This application claims priority under 35 USC §119 to Japanese Patent Application No. 2007-057936, filed on Mar. 8, 2007, the entire contents of which are herein incorporated by reference.

BACKGROUND OF THE INVENTION

1. Field of the Invention

This invention relates to an image forming apparatus, such as a copier, a printer, a facsimile, a multifunctional machine, etc., and a fixing device installed in the image forming apparatus.

2. Discussion of the Background Art

It is well known in an image forming apparatus that a fixing belt is wound around a plurality of rollers as discussed in the Japanese Patent Application Laid Open No. 11-2982. Specifically, the image forming apparatus includes an endless fixing belt, a plurality of rollers supporting the fixing belt, a heater installed in one of the rollers, and a pressure applying roller or the like. The heater applies heat to the fixing belt via the roller. A toner image on a recording medium is fixed by the heat and pressure when conveyed to a nip formed between the fixing belt and the pressure-applying roller.

The Japanese Patent Application Laid Open No. 2002-6656 discusses a fixing device that employs an on-demand system capable of operating in a short warm up time. The on-demand system fixing device includes an endless fixing film as a fixing member, a pressure applying roller, and a heater made of ceramic or the like. The heater is installed inside the fixing film, and forms a nip by contacting the pressure-applying roller via the fixing film. Thus, the heater applies the heat to the fixing film. Then, the toner image on the recording medium is conveyed to the nip and is fixed to the recording medium with the heat and pressure.

The Japanese Patent Application Laid Open No. 2002-251084 discusses a fixing device that employs a fixing belt and a semi cylindrical resistance heat element supporting the fixing belt. The resistance heat element pressure contacts an inner surface of the fixing belt via an insulation layer, a heat element, and a low friction layer, thereby applies heat to the fixing belt.

The fixing device discussed in the Japanese Patent Application Laid Open No. 11-2982 is suitable for speeding up an apparatus in comparison with an apparatus employing a fixing roller. However, there is a limit on decrease in a warm up time period, which is needed until temperature becomes a prescribed level capable of printing, and a first print time period starting from when a print request is made to when a sheet is ejected.

In contrast, the fixing device of the Japanese Patent Application Laid Open No. 2002-6656 can reduce both of the warm up and the first print time periods while downsizing and modifying the apparatus to have a low heat capacity. In such a fixing device, however, only a nip of a fixing film is partially heated, while remaining portions are not sufficiently heated. Thus, due to own rotation, the fixing film becomes coolest at the inlet of the nip, thereby resulting in erroneous fixing. Such a problem cannot be neglected, because when an apparatus is highly speeded, a rotational speed of the fixing film also becomes faster, and accordingly, an amount of heat release from the fixing film increases at a portion other than the nip.

Further, since the heater pressure contacts the pressure-applying roller via the fixing film, the heater can be broken when pressure-contacting force increases. Further, the fixing film and the heater significantly wear when a large thrusting force is applied to the fixing film. Such a problem cannot be neglected when the apparatus is highly speeded, and accordingly either a pressure contacting force at the nip is increased for the purpose of maintaining a preferable fixing performance or a friction force between the heater and the fixing film is increased.

Further, the fixing belt of the fixing device of the 2002-251084 is partially heated at a portion upstream of the nip, and thereby resulting in erroneous fixing easily. Because, the other portion is not sufficiently heated. Further, since the resistance heat element pressure contacts and applies a tension to the fixing belt, the resistance heat element is damaged when the tension increases. Otherwise, serious abrasion can be caused on the fixing belt and the resistance heat element when a large thrusting force is applied to the fixing belt.

SUMMARY OF THE INVENTION

The present invention has been made in view of the above noted and another problems and one object of the present invention is to provide a new and noble fixing device. Such a new and noble fixing device includes a flexible endless fixing member that travels in a prescribed direction and applies heat and melts a toner image, a pressure applying member that pressure contacts the fixing member and forms a nip for conveying a recording medium, and a resistance heat element secured inside an inner circumferential surface of the fixing member, which applies heat to the fixing member. The resistance heat element is arranged not to pressure contact the inner circumferential surface of the fixing member.

In another embodiment, at least a portion of the resistance heat element is distanced from and opposing the inner circumferential surface of the fixing member by a prescribed length.

In yet another embodiment, at least a portion of the resistance heat element contacts the inner circumferential surface by not more than a prescribed pressure.

In yet another embodiment, a metal heat conductor is provided to contact the pressure-applying member via the fixing member and forms a nip. The metal heat conductor includes the resistance heat element on its surface on the fixing member side via an insulation layer.

In yet another embodiment, the metal heat conductor includes a heat insulation layer between the resistance heat element and itself.

In yet another embodiment, the metal heat conductor has a pipe shape.

In yet another embodiment, the resistance heat element opposes the inner circumferential surface of the fixing member except for the nip.

In yet another embodiment, a contact member is secured inside the inner circumferential surface of the fixing member and contacts the pressure-applying member via the fixing member and forms a nip thereon.

In yet another embodiment, the contact member includes a nonconductor member.

In yet another embodiment, the contact member includes a second resistance heat element having an insulation layer on the fixing member side. The contact member is integrated with the resistance heat element.

In yet another embodiment, the resistance heat element has a pipe shape.

In yet another embodiment, the resistance heat element includes a prescribed Curie point.

In yet another embodiment, the resistance heat element includes at least two resistance heat elements arranged to change heat distribution in a widthwise direction.

In yet another embodiment, the fixing member includes one of a fixing belt and a fixing film.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENT OF THE PRESENT INVENTION

Figure 1:
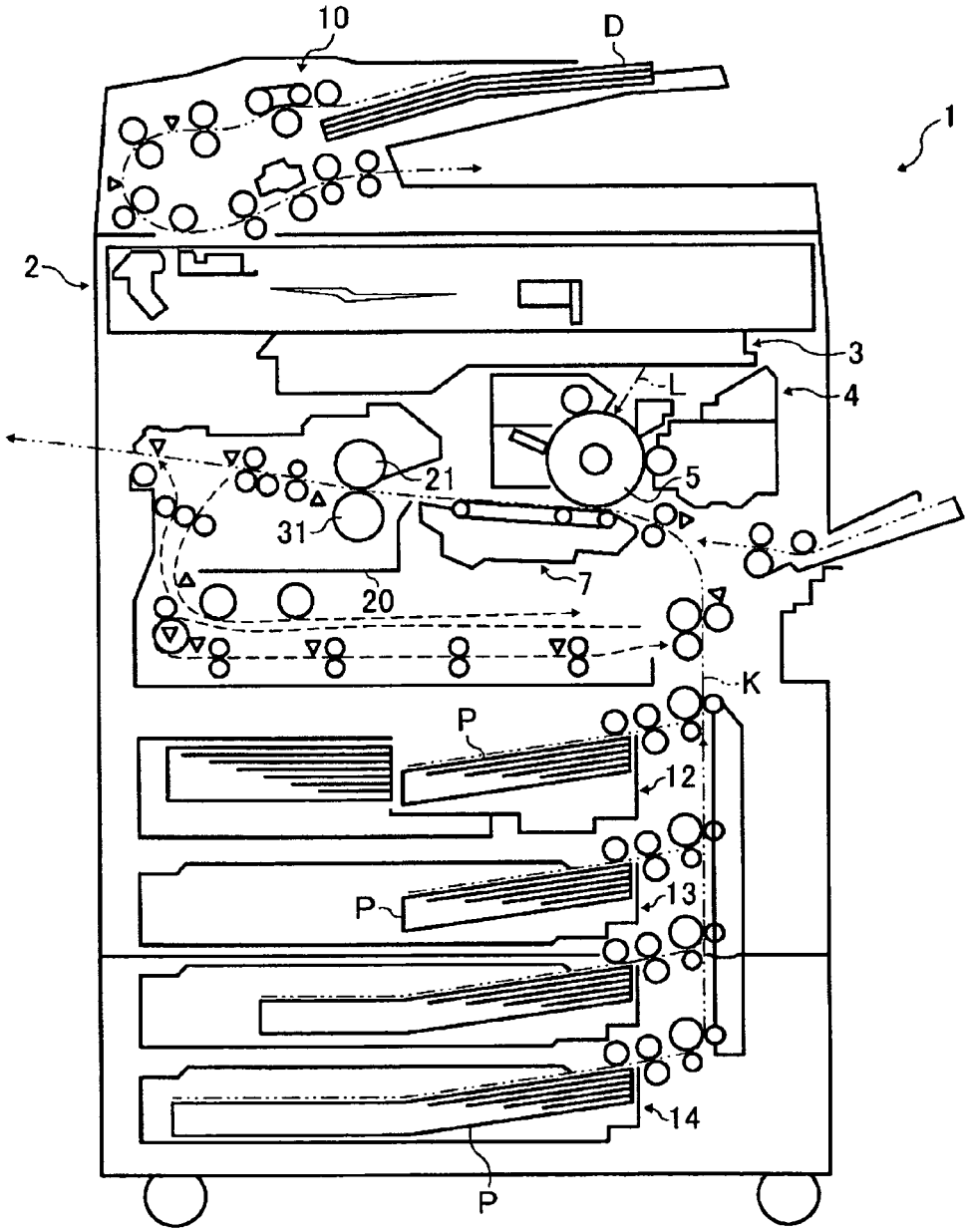
FIG. 1 illustrates an exemplary image forming apparatus according to one embodiment of the present invention.

Referring now to the drawings, wherein like reference numerals and marks designate identical or corresponding parts throughout several figures, in particular in FIG. 1, 1 denotes an apparatus body of a copier as an image forming apparatus. 2 denotes an original document reading section for optically reading image information of the original document D. 3 denotes an exposure section for emitting an exposure light L to an photoconductive drum 5 in accordance with the image information read by the original document reading section 2. 4 denotes an image formation section for forming a toner image on the photoconductive drum 5.

7 denotes a transfer section for transferring the toner image formed on the photoconductive drum 5 onto a recording medium P. 10 denotes an original document conveyance section for conveying an original document D to the original document reading section 2. 12 to 14 denote sheet cassettes accommodating the recording medium P such as transfer sheet. 20 denotes a fixing device for fixing an unfixed image on the recording medium P. 21 denotes a fixing belt installed in the fixing device 20. 31 denotes a pressure-applying roller installed in the fixing device.

Now, an operation of a normal image formation of an image forming apparatus is described with reference to FIG. 1. Initially, the original document D is conveyed from an original document table by a conveyance roller arranged in the original document conveyance section 10 in a direction as shown by an arrow. The original document D then passes through above the original document reading section 2. At this moment, image information of the original document D is optically read by the original document reading section 2.

Then, the image information optically read by the original document reading section 2 is converted into an electric signal, and is then transmitted to an exposure section (a writing section) 3. Further, from the exposure section 3, an exposure light 1, such as a laser light, etc., is emitted toward the photoconductive drum 5 in the image forming section 4 in accordance with the image information of the electric signal In the image forming section 4, the photoconductive drum 5 rotates clockwise, and thus a toner image is formed on the photoconductive drum 5 in accordance with the image information through a prescribed image formation process of charging, exposing, and developing steps. Then, the image on the photoconductive drum 5 is transferred onto the recording medium P conveyed by registration rollers to the transfer station 7.

On the other hand, the recording medium P conveyed to the transfer section 7 is handled as described below. Initially, one of the plurality of sheet cassettes 12 to 14, such as the top most sheet cassette 12, is automatically or manually selected. Then, the uppermost sheet of the recording medium P accommodated in the sheet-feeding cassette 12 is conveyed toward a conveyance path K.

After that, the recording medium P reaches a registration roller passing through the conveyance path K. Then, the recording medium P is conveyed in synchronism with an image formed on the photoconductive drum 5 toward the transfer section 7.

When completing a transfer step and passing through the transfer section 7, the recording medium P arrives at the fixing device 20 via the conveyance path. The recording medium P is then fed between the fixing belt 21 and the pressure-applying roller 31, thereby fixing the image by means of heat applied from the fixing belt and pressure applied from the both members 21 and 31. The recording medium P is launched with the fixed image from a nip formed between the fixing belt 21 and pressure-applying roller 31, and is then ejected from the image forming apparatus body 1. In this way, a sequential image formation process is completed.

Figure 2:
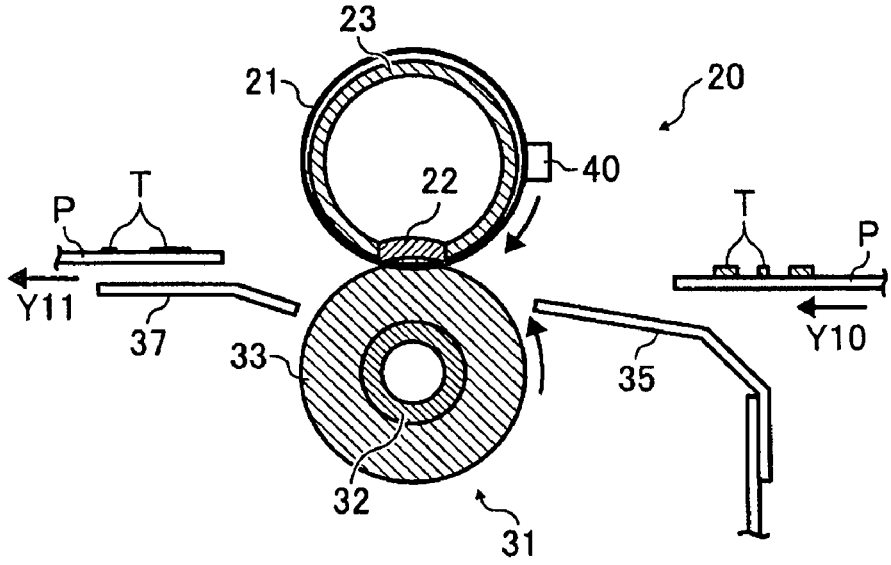
FIG. 2 illustrates an exemplary fixing device installed in the image forming apparatus of FIG. 1.
Figure 3:
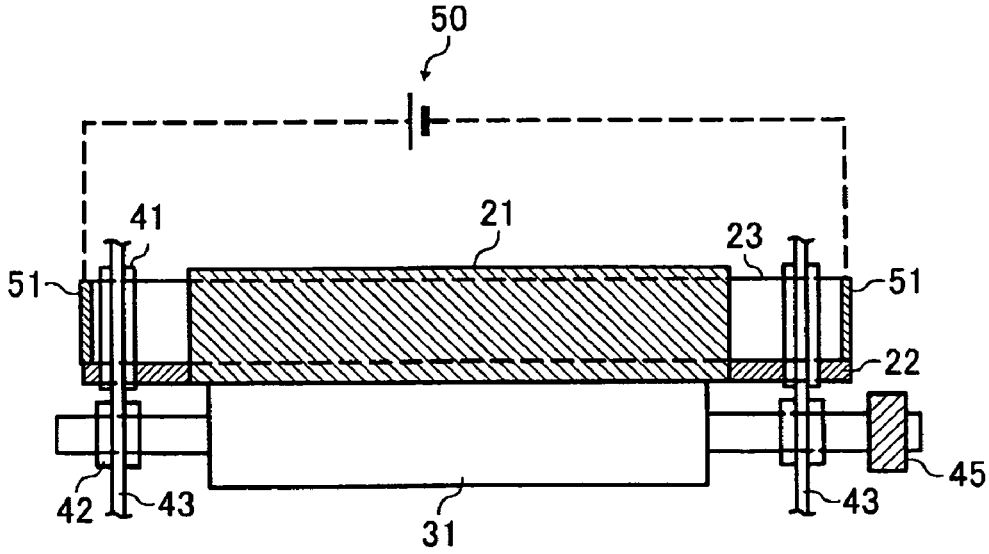
FIG. 3 illustrates the fixing device of FIG. 2 when viewed in a widthwise direction.

Now, an exemplary configuration and operation of a fixing device installed in an image forming apparatus body 1 is described more in detail with reference to FIGS. 2 and 3. As shown in FIG. 2, the fixing device 20 includes a fixing belt 21, a contact member 22, a resistance heat element 23, a pressure applying roller 31, a temperature sensor 41, a plurality of guide plates 35 and 37, or the like.

The fixing belt 21 is thin and flexible as well as endless. The fixing belt travels and rotates clockwise in a direction as shown by an arrow as illustrated in FIG. 2. The fixing belt 21 includes a layer stack in the order of a substrate, an elastic layer, and a releasing layer, thereby having a thickness of not more than 1 mm. The substrate of the fixing belt 21 includes a thickness of 30 to 50 micrometer, and is made of metal such as nickel, stainless, etc., or a plastic such as polyimide, etc. The elastic layer has a thickness of from 100 to 300 micrometer, and is made of rubber, such as silicone rubber, foam silicone rubber, fluorine rubber, etc. By thus arranging the elastic layer, fine unevenness disappears from a surface of a toner image T on the recording medium P at the nip, and accordingly heat is uniformly transmitted thereto. Accordingly, a poor image with uneven brightness is not formed. The releasing layer of the fixing belt 21 has a thickness of from 10 to 50 micrometer, and is made of material, such as PFA (Tetraethylene-perfluoroalkyl-vinylether copolymer resin), polyimide, polyetherimide, PES (polyethersulfide), etc. By thus arranging the release layer, a releasing performance in relation to the toner T can be exerted.

A diameter of the fixing belt 21 is from 15 to 120 mm. In a first example, the diameter is 30 mm. Inside the fixing belt, the contact member 22 and the resistance heat element 23 or the like are secured. The fixing belt 21 receives pressure from the contact member 22 and forms a nip between the pressure applying roller 31 and itself.

Specifically, the contact member 22 contacts the pressure-applying roller 31 via the fixing belt thereby forming a nip. As shown in FIG. 3, the contact member 22 is secured and supported by a pair of side plates 43 of the fixing device 20 at its widthwise ends via a pair of holding members 41. As shown in FIG. 2, the contact member 22 includes the same curvature as the pressure-applying roller 31 at its portion opposing the pressure-applying roller 31. Thus, a problem in that the recording medium P attracts and is hardly separated from the fixing belt 21 after the fixing step can be resolved. Because, the recording medium P can be launched from the nip along the curvature of the pressure applying roller 31. The contact member 22 is made of nonconductive material of an insulation member, such as plastic, ceramic, glass, etc. Thus, the contact member 22 does not generate heat even when a voltage is applied to the resistance heat element 23 as mentioned later in detail. The contact member 22 preferably has rigidity of a certain level so as not to be largely bent by pressure applied from the pressure-applying roller 31. Further, a thrusting surface of the contact member 22 preferably includes a material having a low friction coefficient so that abrasion of the fixing belt 21 can be reduced even when the contacts member 22 contact the fixing belt 21.

As shown in FIG. 2, the resistance heat element 23 is substantially formed in a pipe shape, and is secured entirely opposing the inner circumferential surface of the fixing belt 21 except for the nip. As shown in FIG. 3, the resistance heat element 23 is securely supported by the pair of side plates 43 of the fixing device 20 at its widthwise ends via the pair of holding members 41. Further, a power supply 50 is connected to the widthwise ends of the resistance heat element 23 via a pair of electrodes 51. Thus, when power is supplied from the power supply 50 to the resistance heat element 23 and current flows through the resistance heat element 23, temperature of the resistance heat element 23 increases due to own electric resistance. As a result, the fixing belt 21 is heated by radiation of the heat from the resistance heat element 23. Specifically, the fixing belt 21 is entirely heated except for the nip by the resistance heat element 23, and the heat is transmitted to the toner image T on the recording medium P from the surface of the fixing belt 21. Thus, by employing the resistance heat element 23, the fixing belt 21 can be heated at relatively low cost while maintaining efficiency. An output of the power supply 50 is controlled based on a detection result of temperature of the fixing belt by means of a temperature sensor 40, such as a thermistor, etc., arranged opposing the surface of the fixing belt 21. By executing the output control of the power supply 50 in this way, the temperature of the fixing belt 21 can range within an intended level.

As material of the resistance heat element 23, metal such as aluminum, stainless, etc., or a semiconductor such as a blend of ceramic and conductor, etc., is employed. When the resistance heat element 23 includes aluminum, the thickness of the resistance heat element 23 is preferably from 0.05 to 0.2 mm. When the resistance heat element 23 is made of stainless, the thickness is preferably from 0.01 to 0.2 mm, more preferably not more than 0.1 mm. Thus, the fixing belt 21 can be efficiently heated.

The resistance heat element 23 is arranged not to pressure contact the inner circumferential surface of the fixing belt 21. Specifically, the resistance heat element 23 opposes the inner circumferential surface with a prescribed distance, or pressure contacts the same with smaller pressure. In other words, the resistance heat element 23 opposes the inner circumferential surface with a small gap, or contacts the same at a slight pressure.

Specifically, the gap δ is larger than zero mm and less than 1 mm at a position apart from the nip. The gap δ becomes zero mm near the nip. However, contact force created between the members 21 and 23 at the position is controlled to be less then 0.3 $kgf/cm^2$. Thus, serious abrasion of the fixing belt 21 possibly caused when the resistance heat element 23 and the fixing belt 21 are rubbed against each other can be suppressed. Further, a problem of deterioration of efficiency of heat application to the fixing belt 21 possibly caused by an excessive distance between the resistance heat element 23 and the fixing belt 21 can be resolved. Further, deterioration and damage of the fixing belt 21 due to deformation can be reduced. Because, the resistance heat element 23 is approximated to the fixing belt 21, and accordingly a circular posture of the fixing belt 21 can be maintained maintaining the flexibility of a certain level.

Thus, the fixing device 20 according to this embodiment can be downsized avoiding long warm up and late first print time periods. Because, the fixing belt 21 can be efficiently heated by a relatively simple construction. Especially, when the substrate of the inner circumferential surface of the fixing belt 21 is made of metal, electric leakage does not occur between both of the members 21 and 23. Because, the resistance heat element 23 is arranged not to contact the inner circumferential surface of the fixing belt 21. To credibly avoid such leakage, an insulation layer is preferably arranged on an opposing surface of one of the members 21 and 23.

As mentioned heretofore, the contact member 22 and the resistance heat element 23 are separated. Further, the resistance heat element 23 heats the entire region of the fixing belt except for the nip. Thus, occurrence of fixing error can be suppressed. Because, substantially the entire fixing belt 21 is sufficiently heated in its circumferential surface direction by the resistance heat element 23 avoiding partial heat concentration even though the apparatus is highly speeded.

Further, problems in that the inner circumferential surface is intensely rubbed by the resistance heat element 23 and driving torque increases each when the resistance heat element 23 is bent can be resolved even though the resistance heat element 23 is made thin for the purpose of improving heat efficiency of the fixing belt 21. Because, the resistance heat element 23 is separate from the contact member 22 receiving the pressure. Specifically, even though the central portion of the contact member 22 in the widthwise direction is largely bent by pressure applied to the widthwise ends from the pressure applying roller 31, the resistance heat element 23 is not bent.

Further, the contact member 22 is made of the nonconductor member. Thus, a current does not flow through the contact member 22. Even though, the substrate (inner circumferential surface) is made of the metal, the short (leakage) possibly caused by the pressure contact of the contact member 22 with the fixing belt 21 does not occur therebetween. Further, the resistance heat element 23 heats the fixing belt 21, while the contact member 22 does not heats the fixing belt 21.

Accordingly, the fixing belt 21 is sufficiently heated by the resistance heat element 23 so that the nip receives heat to have temperature capable of fixing. Since the nip does not receive the positive heat, calorie of the fixing belt 21 is given to an unfixed image on the recording medium P and is spent for melting and fusing the toner. As a result, the temperature of the fixing belt 21 decreases. At this moment, the recording medium P is launched from the nip while temperature of a boundary between the fixing belt 21 and the image surface is lower than that for fixing. Accordingly, the recording medium P is preferably separated from the fixing belt 21 because of decrease in sticking force of the toner. Specifically, by designing the contact member 22 not to heat the fixing belt 21, a separation performance of the recording medium P launched from the nip is improved.

The resistance heat element 23 preferably includes a prescribed Curie point at which a value of resistance of the resistance heat element 23 sharply changes and temperature does not increase any more. When the temperature of the resistance heat element 23 does not reach the Curie point such as in a normal condition, and a current flows to the resistance heat element 23, temperature of the resistance heat element 23 increases and that of the fixing belt 21 (the resistance heat element 23) increases up to a prescribed level. In contrast, when the temperature of the resistance heat element 23 reaches the Curie point, a value of resistance of the resistance heat element 23 is sharply increased, and a current does not flow though the resistance heat element 23. Owing to stop of the heat generation of the resistance heat element 23, excessive temperature increase of the fixing belt 21 (i.e., the resistance heat element 23) can be suppressed. Thus, even when small size sheets are successively fed, partial temperature increase and decrease in the fixing belt 21 (the resistance heat element 23) can be readily suppressed. The Curie point of resistance heat element 23 is preferably set to a high level capable of avoiding an offset on an output image, such as 180 degree centigrade.

As shown in FIG. 2, the pressure-applying roller 31 has a diameter of 30 mm, and includes a hollow core metal 32 and an elastic layer 33 overlying thereon. The elastic layer 33 is made of silicone rubber, fluorine rubber, foam silicone rubber or the like. Especially, when the elastic layer is made of sponge like rubber such as a foam silicone rubber, etc., a warm up time period can be reduced. Because, heat conductivity from the fixing belt 21 to the pressure applying roller 31 decreases. A thin releasing layer such as PFA, PTFE, etc., can be arranged as a surface layer of the elastic layer. The pressure applying roller 31 pressure contacts the fixing belt 21 and forms a prescribed nip therebetween. As shown in FIG. 3, a gear 45 meshes with a driving gear included in a driving mechanism, not shown, and is attached to the pressure applying roller 31. The pressure-applying roller 31 is thus rotated counterclockwise as shown by an arrow as illustrated in FIG. 2. The pressure applying roller 31 is freely rotationally supported by a pair of side plates of the fixing device 20 via a pair of bearings 42 at its widthwise ends. A heat source such as a halogen heater, etc., can be installed in the pressure-applying roller 31. Although the diameters of the fixing belt 21 and the pressure applying roller 31 are the same in this embodiment, that of the fixing belt 21 can be smaller than that of the pressure applying roller 31. In such a situation, since a curvature of the fixing belt 21 is smaller than that of the pressure-applying roller 31 at the nip, the recording medium P launched from the nip becomes readily separated from the fixing belt 21.

Further, a guide plate (e.g. an inlet guide plate) 35 is arranged to guide a recording medium P conveyed toward an inlet side of the nip formed between the fixing belt 21 and the pressure-applying roller 31. On the outlet side of the nip, another guide plate (e.g. an outlet guide plate) 37 is arranged to guide the recording medium P launched from the nip. Both of the guide plates 35 and 37 are secured to the side plates 43.

An exemplary operation of the above-mentioned fixing device 20 is now briefly described. When a power source switch provided in the apparatus body 1 is turned on, power is supplied from the power source to the resistance heat element 23 via the electrodes 51, and the pressure applying roller 31 starts rotating in a direction as shown by an arrow in FIG. 2. Due to friction between the pressure applying roller 31 and the fixing belt 21, the fixing belt 21 is driven in a direction as shown by an arrow as illustrated in FIG. 2. Then, a recording medium P is fed from one of the sheet cassettes 12 to 14, and carries a non-fix image in the image formation station 4. The recording medium P with the non-fixed image T is conveyed in a direction Y10 as illustrated in FIG. 2 while being guided by the guide plate 32. The recording medium P is then entered into the nip between the fixing belt 21 and the pressure-applying roller 31 in the pressure contacting condition. Then, by means of heat applied from the fixing belt 21 heated by the resistance heat element 23 and pressure collectively caused by the contact member 22 and the pressure-applying roller 31, the toner image on the recording medium P is fixed. Then, the recording medium P is conveyed in a direction Y11 from the nip.

As mention heretofore, the resistance heat element 23 is secure not to contact the inner circumferential surface of the endless fixing belt 21. Thus, both warm up and first print time periods taken by the fixing device can be reduced. Further, even when the apparatus is highly speeded, problems such as fixing error, abrasion, and damage on the resistance heat element 23 and fixing belt 21 can be suppressed.

Instead of the fixing device including a pressure-applying roller 31, a fixing device employing a pressure applying belt or pad can be employed. In such a situation, the same effect as the first embodiment can be obtained.

Further, although the first embodiment employs a multi layer fixing belt 21, an endless fixing film made of polyimide, polyamide, fluorine resin, and metal or the like can be employed. In such a situation, the same effect as the first embodiment can be obtained.

Figure 4:
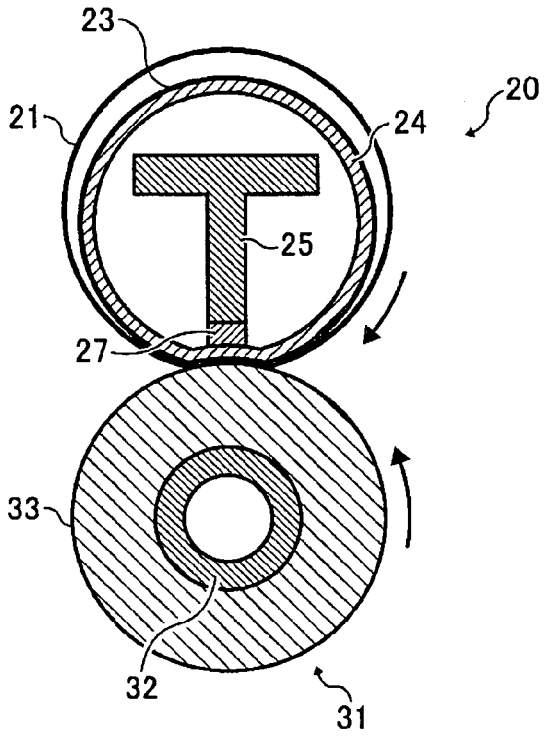
FIG. 4 illustrates an exemplary fixing device according to another embodiment of the present invention.
Figure 5:
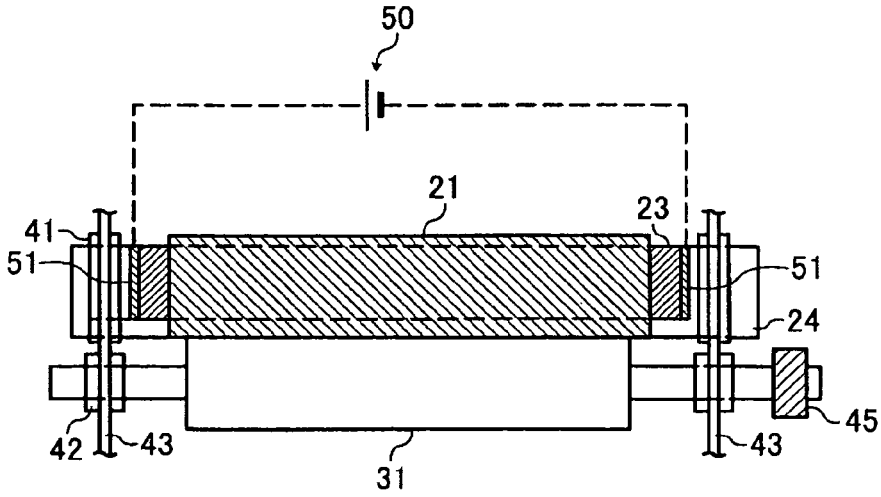
FIG. 5 illustrates the fixing device of FIG. 4 when viewed in a widthwise direction.

Now, with reference to FIGS. 4 and 5, a second embodiment is described. The difference from the first embodiment is that a metal heat conductor 24, a reinforcing member 25, and a heat insulation member 27 are newly employed while a nip is formed almost flat in a fixing device of the second embodiment.

Specifically, as shown in FIGS. 4 and 5, the fixing device 20 of the second embodiment includes a fixing belt 21, a metal heat conductor 24, a resistance heat element 23, a reinforcing member 25, a heat insulation member 27, and a pressure applying roller 31 or the like. The metal heat conductor 24 is formed like a pipe and is secured to the fixing belt 21 at an inner circumferential surface of the fixing belt 21. The metal heat conductor 24 contacts the pressure-applying roller 31 via the fixing belt and forms a nip. The metal heat conductor 24 is made of metal such as aluminum, copper, iron, etc., having heat conductivity Further, a resistance heat element 23 is adhered to the surface of the metal heat conductor 24 (the surface on the side of the fixing belt 51) via an insulation layer, not shown. For the resistance heat element 23, material including carbon black or a metal thin film resistance member having punching of a heat generation pattern is employed beside the above-mentioned example. As shown in FIG. 5, the metal heat conductor 24 is securely supported by a pair of side plates 43 of the fixing device 20 at its widthwise ends. Further, a power supply 50 is connected to the widthwise ends of the resistance heat element 23.

With such a construction, when the power supply 50 supplies power to the resistance heat element 23, and a current flows through the resistance heat element 23, temperature of the resistance heat element 23 increases by its own electric resistance. Further, the resistance heat element 23 thus heated applies the heat to the metal heat conductor 24, and the fixing belt 21 is finally heated by heat irradiation from the resistance heat element 23 and the metal heat conductor 24. Specifically, according to the second embodiment, the fixing belt 21 including the nip is entirely heated over its circumferential surface by the resistance heat element 23 and the metal heat conductor 24, heat is applied to the toner image T on the recording medium P from the surface of the heated fixing belt 21. Thus, since the metal heat conductor 24 is arranged on the inner circumferential surface of the resistance heat element 23, temperature unevenness becomes smaller in both widthwise and circumferential directions of the resistance heat element 23. Accordingly, temperature of the fixing belt 21 is stable. Especially, even when small sized sheets are successively fed, excessive temperature increase of the fixing belt 21 at its widthwise ends can be suppressed. Because, heat travels from the resistance heat element 23 to the metal heat conductor 24.

The resistance heat element 23 is arranged not to pressure contact the inner circumferential surface of the fixing belt 21. Thus, a problem of serious abrasion generally caused on the fixing belt 21 when the resistance heat element 23 contacts and rubs against the fixing belt 21 can be suppressed. Accordingly, the fixing belt 21 can be efficiently heated. Specifically, due to application of heat to the fixing belt 21 even including the nip having relatively a narrow width, a fixing error can be suppressed.

As shown, the reinforcing member 25 is secured inside the inner circumferential surface of the fixing belt 21 to reinforce rigidity of the metal heat conductor 24 at the nip. A width, not shown, of the reinforcing member 25 is as same as the metal heat conductor 24, and the widthwise ends of the reinforcing member 25 are secured to and supported by the side plates 45. Since the reinforcing member 25 contacts the pressure-applying roller 31 via the metal heat conductor 24 and the fixing belt 21, large deformation of the metal heat conductor 24, generally created by application of pressure from the pressure-applying roller 31, is suppressed at the nip.

Specifically, when the reinforcing member 25 is not employed, the metal heat conductor 24 receives the pressure from the pressure applying roller 31 and is largely bent at its widthwise central portion due to application of the pressure to widthwise ends. Especially, when the metal heat conductor 24 is thin in order to improve heat application efficiency of the fixing belt 21, such a problem becomes serious. However, since the reinforcing member 25 is arranged at a position suitable for suppressing deformation of the metal heat conductor 24, a bending amount of the metal heat conductor 24 can be decreased even though the metal heat conductor 24 becomes thinner. Thus, problems in that the metal heat conductor 24 is bent and thereby the inner circumferential surface of the fixing belt 21 is intensely rubbed and accordingly driving torque of the fixing belt 21 increases can be suppressed. For the reinforcing member 25, metal, such as stainless, iron, etc., is preferably employed so as to exert the above-mentioned function. Further, by designing a cross section of the reinforcing member 25 to have a long rectangular shape along the pressure applying direction of the pressure applying roller 31, a mechanical intensity of the reinforcing member 25 can be increased due to its increase in cross sectional coefficient.

Further, different from the first embodiment, the nip is substantially flat as mentioned earlier. Specifically, an opposing surface (a surface opposing the pressure applying roller 31) of the metal heat conductor 24 becomes flat. Thus, a shape of the nip becomes substantially flat in parallel to the recording medium P, and increases a contact performance of the fixing belt 21 to contact the recording medium P, thereby improving a fixing performance as well. Further, since a curvature of the fixing belt 21 becomes larger on the outlet side of the nip, the recording medium P launched from the nip can be readily separated from the fixing belt 21.

Further, according to the second embodiment, the heat insulation member 27 is arranged between the metal heat conductor 24 and the reinforcing member 25 as shown in FIG. 4. For the heat insulation member 27, foam silicone and heat-resistant felt or the like can be used. In such a situation, a problem of erroneous fixing generally caused by deterioration of heat application to the fixing belt 21 due to conduction of the heat of the metal heat conductor 24 to the reinforcing member 25 at the nip can be suppressed As described heretofore, also in this embodiment, as similar to the first embodiment, the resistance heat element 23 is secure inside the inner circumferential surface of the endless fixing belt 21 not to contact the inner circumferential surface. Thus, both warm up and first print time periods taken by the fixing device can be decreased. Further, even when the device is highly speeded, problems of erroneous fixing, and abrasion, as well as damage both on the fixing belt 21 and the resistance heat element 23 can be suppressed.

Further, the heat insulation member 27 is arranged between the metal heat conductor 24 and the resistance heat element 23. In such a situation, heat transfer from the resistance heat element 23 to the metal heat conductor 24 can be suppressed. Instead, the heat is directly supplied to the fixing belt 21. Accordingly, temperature increasing efficiency is improved in the fixing belt 21.

Now, a third embodiment is described with reference to FIG. 6. A fixing device according to the third embodiment is different from that of the second embodiment by additionally employing a metal heat conductor 24 and a gap formed between the metal heat conductor 24 and the contact member 22.

Figure 6:
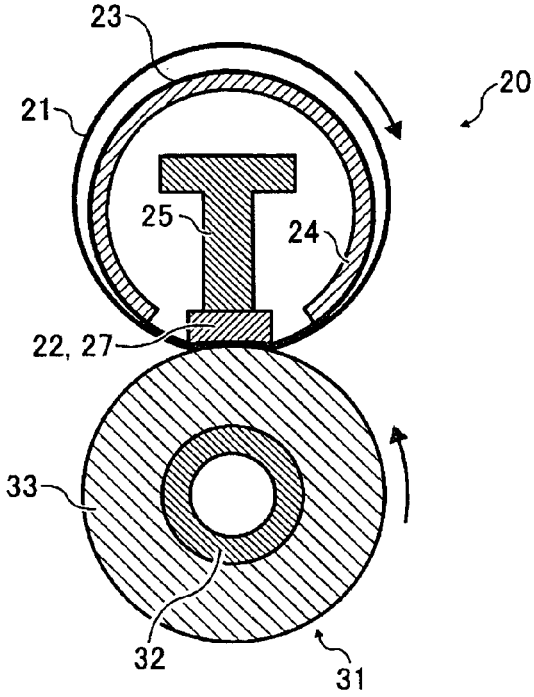
FIG. 6 illustrates an exemplary fixing device according to still another embodiment of the present invention.

As shown in FIG. 6, the fixing device of the third embodiment includes a fixing belt 21, a metal heat conductor 24, a resistance heat element 23, a reinforcing member 25, a contact member 22, and a pressure applying roller 31 or the like as in the second embodiment. The contact member 22 is made of a heat insulation member. Otherwise, the surface of the contact member 22 includes a heat insulation layer. In anyway, the contact member 22 also serves as an insulation member 27. Thus, a problem of deterioration of efficiency of heat application to the fixing belt 21 due to transfer of heat of the fixing belt 21 to the contact member 22 can be suppressed.

In the fixing device of the third embodiment, the contact member 22 and the metal heat conductor 24 are arranged separate from each other. Specifically, an air gap is formed between the members 22 and 24 not contacting those to each other. The air gap 24 functions as an insulation layer, and accordingly, heat of the metal heat conductor 24 is conveyed to the contact member 22, thereby deterioration of heat application efficiency of the fixing belt 21 can be suppressed. Specifically, since heat to be transmitted to the contact member 22 is transmitted instead to the fixing belt 21, the entire fixing belt 21 except for the nip can be efficiently heated by the resistance heat element 23 and the metal heat conductor 24.

Thus, the resistance heat element 23 and the metal heat conductor 24 apply heat to the fixing belt 21, while the contact member 22 does not apply the heat to the fixing belt 21. Accordingly, the fixing belt 21 is sufficiently heated until the nip is heated up by the resistance heat element 23 and the metal heat conductor 24, thereby temperature becomes a level capable of fixing. Further, since the nip doe not receive heat, calorie of the fixing belt 21 is given to a non-fix image on the recording medium P and is spent for melting and fixing the toner, thereby temperature of the fixing belt 21 decreases. At this moment, since temperature decreases down to a lower level at a boundary between the fixing belt 21 and the image surface than that of the fixing, the recording medium P is preferably launched from the nip. Specifically, the recording medium P is preferably separated from the fixing belt 21 on condition that a sticking force of the toner decreases. Specifically, by designing the contact member 22 not to apply heat to the fixing belt 21 at the nip, a separation performance of the recording medium P launched from the nip can be improved.

As mentioned heretofore, the resistance heat element 23 is secured not to pressure contact the inner circumferential surface of the fixing belt 21. Thus, both of the warm up and first print time periods can be decreased. Further, even when the apparatus is highly speeded, problems of erroneous fixing, and abrasion, as well as damage on both of the fixing belt 21 and the resistance heat element 23 can be suppressed.

Figure 7:
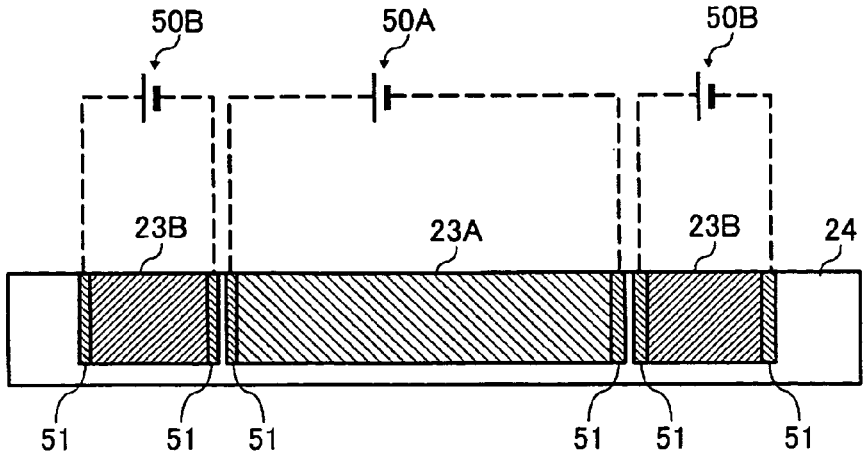
FIG. 7 illustrates an exemplary resistance heat element included in an fixing device according to still another embodiment of the present invention when viewed in a widthwise direction.

Now, a fourth embodiment is described with reference to FIG. 7. A fixing device of the fourth embodiment is different from the second embodiment by arranging a plurality of resistance heat elements 23A and 23B in its widthwise direction.

The fixing device 20 includes a fixing belt 21, a metal heat conductor 24, plural resistance heat elements 23A and 23B, and a pressure applying roller 31 or the like, as in the second embodiment.

It is not illustrated, but the resistance heat elements 23A and 23B are arranged not to pressure contact the inner circumferential surface of the fixing belt 21.

The resistance heat element of this embodiment includes a plurality of resistance heat elements to change heat generation distribution in their widthwise direction. Specifically, the resistance heat elements 23A and 23B are arranged at almost the center and widthwise ends, respectively. To widthwise ends of each of the plurality of resistance heat elements 23A and 23B, a power supply is connected via electrodes 51. Further, plural switches are connected to plural circuits including the power sources 50A and 50B, respectively.

In a normal operation, all of the switches of the power supplies 50A and 50B are connected, and thus the entire width of the fixing belt 21 (resistance heat element 23) is heated. Whereas when a recording medium P with a small width is fed, only a switch of the power supply 50A corresponding to the resistance heat element 23A is connected, thereby only the center is heated. Thus, even when the small size sheets are successively fed, excessive temperature increase in the widthwise direction of the fixing belt 21 can be suppressed.

As mention heretofore, according to the fourth embodiment, Similar to the other embodiments, the resistance heat elements 23A and 23B are secured on the inner circumferential surface side of the endless fixing belt 21 not to pressure contact the inner circumferential surface of the fixing belt 21. Thus, both of the warm up and first print time periods can be decreased. Further, even when the apparatus is highly speeded, problems of erroneous fixing and abrasion as well as damage on both of the fixing belt 21 and the resistance heat elements 23A and 23B can be suppressed.

Figure 8:
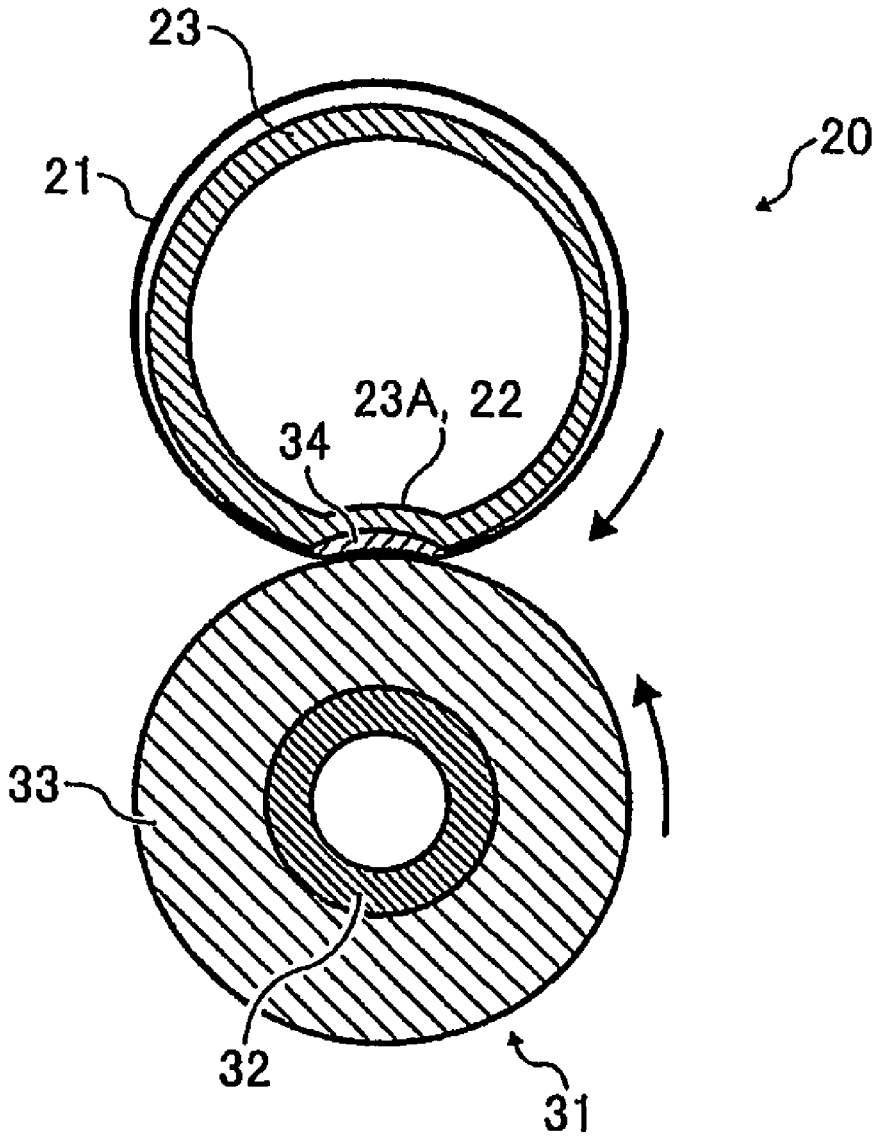
FIG. 8 illustrates an exemplary image forming apparatus according to still another embodiment of the present invention.

Now, a fifth embodiment is described with reference to FIG. 8.

In a fixing device of this embodiment, a resistance heat element 23 is entirely arranged over the inner circumferential surface different from the first embodiment.

Specifically, the fixing device 20 includes a fixing belt 21, a resistance heat element 23, a pressure applying roller 31 and the like as in the first embodiment. Further, the resistance heat element 23 is arranged not to pressure contact the inner circumferential surface of the fixing belt 21 at the positions other than the nip.

A second resistance heat element 23A is newly arranged as a contact member for forming a nip. The second resistance heat element 23A is made of the same material as the resistance heat element 23 and integral therewith. Further, the second resistance heat element 23*a* includes an insulation layer 34 on its front surface (i.e., a surface opposing the fixing belt 21).

Thus, since the fixing belt 21 is entirely heated including the nip by the resistance heat elements 23 and 23A, efficiency of heat application to the fixing belt 21 is improved. Further, the insulation layer 34 is arranged between the second resistance heat element 23A and the fixing belt 21, short circuit (leakage) between the members 21 and 35 due to the contact pressure at the nip can be suppressed even when the substrate (i.e., the inner circumferential surface) of the fixing belt 21 is made of metal.

As mentioned heretofore, according to the fifth embodiment, the resistance heat element 23 is secured inside the inner circumferential surface of the endless fixing belt 21 not to pressure contact the inner circumferential surface as in the earlier described embodiments. Thus, both of the warm up and first print time periods can be decreased. Further, even when the apparatus is highly speeded, problems of erroneous fixing and abrasion as well as damage on both of the fixing belt 21 and the resistance heat element 23 can be suppressed.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A fixing device comprising:

a fixing member configured to travel in a prescribed direction and apply heat to a toner image formed on a recording medium;

a pressure applying member configured to pressure contact the fixing member and form a nip on the fixing member, said nip conveying the recording medium downstream;

a resistance heat element secured inside the fixing member and configured to apply heat to the fixing member; and a contact member secured inside the fixing member and configured to contact the pressure-applying member via the fixing member at the nip, wherein a first portion of said resistance heat element does not pressure contact an inner circumferential surface of the fixing member, the first portion of said resistance heat element faces the inner circumferential surface of the fixing member via a gap, and the gap is void and not more than 1 mm, wherein a second portion of said resistance heat element contacts said inner circumferential surface of the fixing member by a pressure not more than a prescribed amount at a contact section.

2. The fixing device as claimed in claim 1, further comprising a metal heat conductor configured to contact the pressure applying member via the fixing member; wherein said resistance heat element overlies the metal heat conductor via an insulation layer.

3. The fixing device as claimed in claim 2, wherein a heat insulation layer is formed between the resistance heat element and the metal heat conductor.

4. The fixing device as claimed in claim 2, wherein said metal heat conductor is a pipe shape.

5. The fixing device as claimed in claim 1, wherein said resistance heat element opposes the inner circumferential surface of the fixing member except for the nip.

6. The fixing device as claimed in claim 1, wherein said contact member includes a nonconductor member.

7. The fixing device as claimed in claim 1, wherein said contact member includes an additional resistance heat element, said additional resistance heat element having an insulation layer on the fixing member side, wherein said contact member is integrated with the resistance heat element.

8. The fixing device as claimed in claim 1, wherein said resistance heat element is a pipe shape.

9. The fixing device as claimed in claim 1, wherein said resistance heat element includes a prescribed Curie point.

10. The fixing device as claimed in claim 1, wherein said resistance heat element includes at least two resistance heat elements arranged in a widthwise direction, each of said at least two resistance heat element being independently controlled.

11. The fixing device as claimed in claim 1, wherein said fixing member includes fixing belt.

12. An image forming apparatus comprising the fixing device as claimed in claim 1.

13. The fixing device as claimed in claim 1, wherein said contact section is located at a portion where the fixing member does not contact the contact member.

14. The fixing device as claimed in claim 1, wherein said prescribed amount is 0.3 $kgf/cm^2$.

15. The fixing device as claimed in claim 1, further comprising:

an insulation layer overlying at least one of the inner circumferential surface of the fixing member and an outer circumferential surface of the resistance heat element.

16. The fixing device as claimed in claim 15, wherein said insulation layer is made of polyimede and serves as a substrate of the fixing member.

17. The fixing device as claimed in claim 1, wherein said contact section is arranged adjacent to the nip.

18. The fixing device as claimed in claim 1, further comprising:

a pair of supporting plates arranged at both widthwise side ends of the fixing member, said pair of side supporting plates firmly supporting the resistance heat element at its both side ends, respectively.

19. The fixing device as claimed in claim 18, further comprising:

a pair of holding members configured to hold the resistance heat element at its both side ends, wherein said pair of supporting plates firmly supporting the resistance heat element via the pair of holding members, respectively.

20. The fixing device as claimed in claim 18, wherein said pair of supporting plates firmly supporting contact member.

21. A fixing device comprising:

a fixing member configured to travel in a prescribed direction and apply heat to a toner image formed on a recording medium;

a resistance heat element secured inside the fixing member and configured to apply heat to the fixing member;

a pressure-applying member configured to pressure contact the fixing member; and a contact member secured inside the fixing member and configured to contact the pressure-applying member via the fixing member thereby forming a nip on the fixing member, said nip conveying the recording medium downstream, wherein the pressure applying member pressure contacts the contact member via the fixing member so as not to cause tension in the fixing member when the fixing member stops moving, wherein a portion of said resistance heat element contacts the fixing member without providing tension to the fixing member when the fixing member stops moving.

22. The fixing device of claim 21, wherein said fixing member contacts the portion of said resistance heat element by a pressure not more than 0.3 $kgf/cm^2$ at a contact section.

* * * * *